US008115781B2

(12) United States Patent
Chen et al.

(10) Patent No.: US 8,115,781 B2
(45) Date of Patent: Feb. 14, 2012

(54) SYSTEMS AND METHODS OF IMAGE PROCESSING INCLUDING REMOVAL OF DISCONTINUOUS RAMP AND/OR SMOOTHING FEATURES

(75) Inventors: Chun-Wei Chen, Taipei (TW); Jiande Jiang, San Jose, CA (US); Zheng Liu, Sunnyvale, CA (US); Richard Liang, Cupertino, CA (US)

(73) Assignee: Trident Microsystems (Far East) Ltd., Grand Cayman (KY)

( * ) Notice: Subject to any disclaimer, the term of this patent is extended or adjusted under 35 U.S.C. 154(b) by 710 days.

(21) Appl. No.: 12/202,321

(22) Filed: Aug. 31, 2008

(65) Prior Publication Data

US 2010/0053202 A1 Mar. 4, 2010

(51) Int. Cl.
*G09G 5/00* (2006.01)

(52) U.S. Cl. ..... 345/616; 345/611

(58) Field of Classification Search ..... 345/611, 345/616

See application file for complete search history.

(56) References Cited

U.S. PATENT DOCUMENTS 7,043,089 B2 * 5/2006 Ballard ..... 382/237
7,280,121 B2 * 10/2007 Nakahashi et al. ..... 345/611

* cited by examiner

*Primary Examiner* — Andrew Wang
*Assistant Examiner* — Peter Hoang
(74) *Attorney, Agent, or Firm* — DLA Piper LLP (US)

(57) ABSTRACT

Systems and methods are disclosed for processing image data to provide adjusted pixel information that achieves smoothed output discontinuities. In one exemplary embodiment, there is provided a method of processing image data including analyzing first display information including pixel data indicative of pixel display on a graphical user interface, detecting one or more ramp steps in the pixel data, and assigning, in association with random number generation and/or threshold setting functionality, a carry possibility for a pixel adjacent the one or more ramp steps. Other exemplary implementations may include generating second display information included adjusted pixel data for pixels adjacent the ramp steps. Consistent with certain implementations, the second display information may include pixel values adjusted according to the carry possibility in one or both of the temporal domain and/or spatial domain.

22 Claims, 8 Drawing Sheets

SYSTEMS AND METHODS OF IMAGE PROCESSING INCLUDING REMOVAL OF DISCONTINUOUS RAMP AND/OR SMOOTHING FEATURES

BACKGROUND

1. Field

The present invention relates to image processing and, more particularly, to systems and methods consistent with smoothing/removing discontinuous ramp in pixel display.

2. Description of Related Information

Image processing environments typically include functionality to create or improve displayed images, such as processing display signals having ramp/step differences of pixel arrangements for smoother display on a monitor. Existing systems for processing display signals sometime include components designed to filter or minimize ramp/step discontinuities. However, existing components, such as low pass filters, cannot provide smoothing when only small (e.g., 1-bit, etc.) differences of ramp/step pixel displacement exist.

Additionally, many sources of noise exist that interfere with the ability of existing systems to adequately smooth pixel ramp/step discontinuities. These systems are unable to remove discontinuities in displayed images that have been affected by such noise, particularly sources of noise that impart random noise onto many if not all of the pixels.

In sum, there is a need for systems and methods that may adequately display images with otherwise problematic pixel display outputs by, for example, smoothing discontinuous ramp or step portions between pixels/frames.

SUMMARY

Systems, methods, and articles of manufacture consistent with the invention relate to smoothing discontinuous pixel segments.

In one exemplary embodiment, there is provided a method of processing image data including analyzing first display information including pixel data indicative of pixel display on a graphical user interface, detecting one or more ramp steps in the pixel data, and assigning, in association with random number generation and/or threshold setting functionality, a carry possibility for a pixel adjacent the one or more ramp steps. Other exemplary implementations may include generating second display information included adjusted pixel data for pixels adjacent the ramp steps. Consistent with certain implementations, the second display information may include pixel values adjusted according to the carry possibility in one or both of the temporal domain and/or spatial domain.

It is to be understood that both the foregoing general description and the following detailed description are exemplary and explanatory only and are not restrictive of the invention, as described. Further features and/or variations may be provided in addition to those set forth herein. For example, the present invention may be directed to various combinations and subcombinations of the disclosed features and/or combinations and subcombinations of several further features disclosed below in the detailed description.

DESCRIPTION OF THE DRAWINGS

The accompanying drawings, which constitute a part of this specification, illustrate various embodiments and aspects of the present invention and, together with the description, explain the principles of the invention. In the drawings.

DETAILED DESCRIPTION

Reference will now be made in detail to the invention, examples of which are illustrated in the accompanying drawings. The implementations set forth in the following description do not represent all implementations consistent with the claimed invention. Instead, they are merely some examples consistent with certain aspects related to the invention. Wherever possible, the same reference numbers will be used throughout the drawings to refer to the same or like parts.

Many techniques are used to process video data for improved display on a graphical user interface. Examples of such techniques are those that employ filtering processes, as well as those that may include pixel interpolation functionality.

In general, aspects of the innovations herein relate to processing image data to adjust pixel values according to the carry possibility in one or both of the temporal domain and/or spatial domain. Exemplary processing associated with such pixel processing include analyzing first display information including pixel data indicative of pixel display on a graphical user interface, detecting one or more ramp steps in the pixel data, assigning, in association with random number generation and/or threshold setting functionality, a carry possibility for a pixel adjacent the one or more ramp steps, and generating second display information included adjusted pixel data for pixels adjacent the ramp steps. Consistent with certain implementations, the second display information may include pixel values adjusted according to the carry possibility in one or both of the temporal domain and/or spatial domain. Further, while illustrating examples herein may be described in the context of discontinuous lines in the vertical direction, the innovations herein may also be applied to discontinuities in the horizontal direction.

Figure 1:
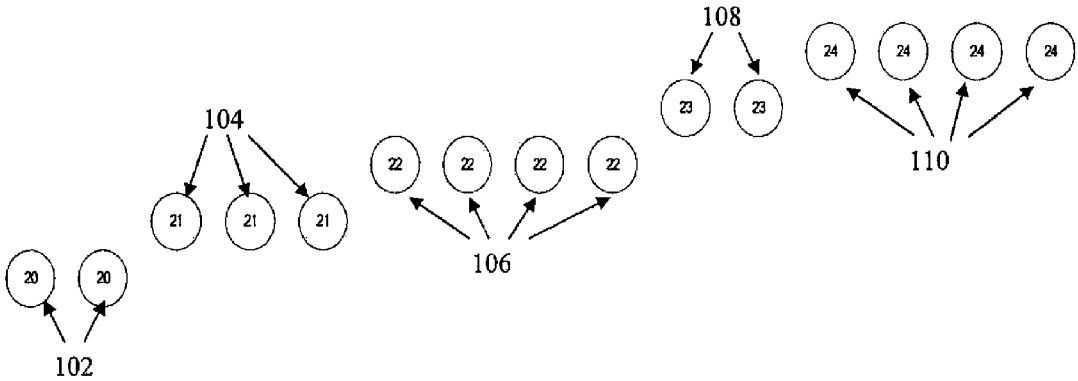
FIG. 1 is a diagram of an existing ramp or step discontinuities in display of pixels.

FIG. 1 illustrates a diagram of an existing ramp or step discontinuities in a representative display of pixels. Referring to FIG. 1, a sequences of pixels along a boundary are shown. FIG. 1 illustrates four ramp regions characterized as the steps between: first pixels 102 of pixel value 20 (i.e., representative YUV, RGB, etc. value of 20) and second pixels 104 of pixel value 21, between second pixels 104 of pixel value 21 and third pixels 106 of pixel value 22, between third pixels 106 of pixel value 22 and fourth pixels 108 of pixel value 23, as well as between fourth pixels 108 of pixel value 23 and fifth pixels 110 of pixel value 24. Despite existing techniques to avoid drawbacks related to these steps, discontinuities such as these can carry though to appearance of a final, displayed image, and may result in noticeable demarcations between regions (e.g., visible irregularities, steps, lines, etc.) and/or other unacceptable graphical output results. In short, existing techniques fail to specify carry values of pixels that serve to obviate discontinuities, such as removing visible discontinuities.

Figure 2:
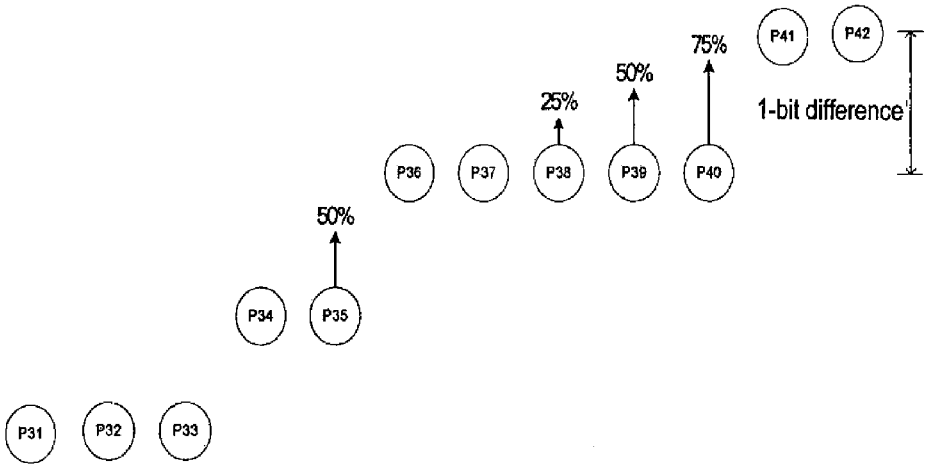
FIG. 2 is a diagram illustrating an exemplary implementation of smoothing consistent with certain aspects related to the innovations herein.

However, differing pixel carry possibilities consistent with aspects related to the innovations herein can be used to effect and/or simulate visual linearity or smoothness unavailable via present systems and techniques. For example, via realization of the carry possibility methods and calculations set forth herein, such as adaptive carry techniques, problems associated with such discontinuities may be eliminated or resolved. As set forth in the carry possibility results shown in FIG. 2, for example, pixels approaching a ramp step boundary may be assigned differing possibilities that the pixel value will be carried over to the pixel value of the neighboring pixel across the ramp step. In this exemplary implementation, a pixel closer to the ramp step (i.e., the pixel at pixel index P39) between P39 and P40 may be assigned a 75% possibility that it will be displayed at the pixel value (YUV or RGB values, level, luminosity, etc.) of the neighboring pixel across the ramp step, i.e., the pixel at pixel index P40. Similarly, pixels extending further away from the ramp step, such as pixels at pixel indexes P37 and P38, may be assigned progressively smaller possibilities that they will be displayed at the pixel value of the pixel across the ramp step. In this illustrative implementation, for example, P38 has been assigned a possibility of 50% and P37 has been assigned a possibility of 25%. By way of further example, P34 may be assigned a carry possibility of 50% as a function of the fewer quantity of pixels that are candidates for carry at the ramp step junction between P34 and P35. While, here, possibility percentages of 25%, 50% and 75% have been used, various other quantities and permutations may be used consistent with the innovations herein. According to some implementations, then, the carry possibility may be set higher as the location of the pixel in question becomes closer to the next ramp step.

Figure 3A:
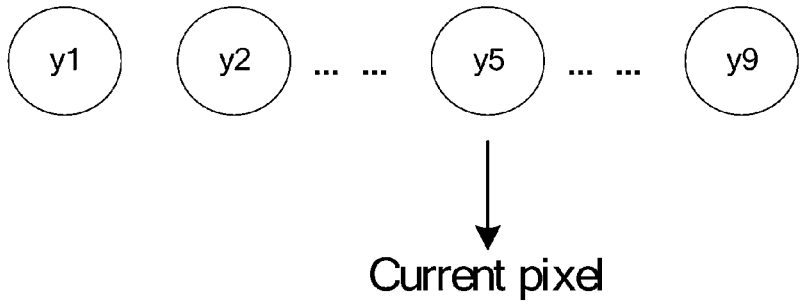
FIGS. 3A-3C are diagrams illustrating exemplary features of smoothing consistent with certain aspects related to the innovations herein.
Figure 3B:
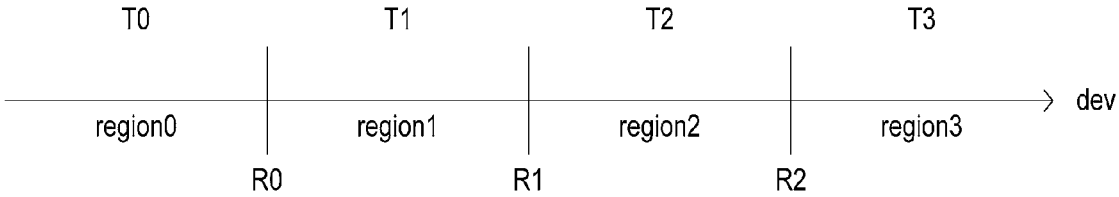
Figure 3C:
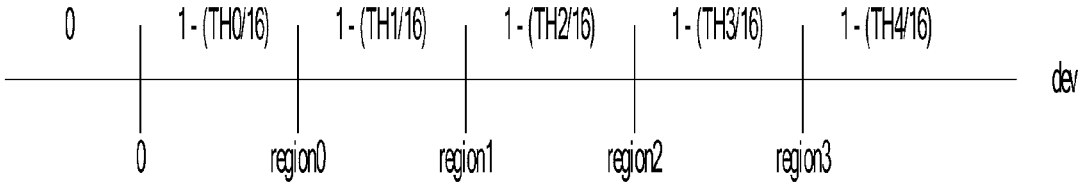

Exemplary Adaptive Carry Possibility by 9-Tap Detection:

FIGS. 3A-3C are diagrams illustrating exemplary features of smoothing consistent with certain aspects related to the innovations herein. Implementations herein are suitable for use with a variety of linear and non-linear techniques for filtering and processing image processing information. Non-linear techniques may include processes such as motion adaptive filtering, non-linear filtering, pattern matching and feature extraction. With reference to non-linear filtering, innovations herein may be employed consistent with 9-tap detection techniques, use of 9-tap weighted median filters or the like, though N-tap filtering and filtering of other varieties are well within the ambit of the innovations herein. As described below and set forth in FIGS. 3A-3C, one exemplary implementation of the innovations herein may be employed consistent with N-tap detection processes, and a 9-tap detection process is described for purposes of illustration not limitation. It should be appreciated, however, that the mathematics can be extended to other/higher N-length detection processes, again, within the scope of the present innovations.

With regard to smoothing via filtration consistent with the subject matter herein, various filters such as basic low pass filters are impractical because of their inability to effectively handle small changes, such as 1-bit differences on ramp steps. As such, some adaptive carry possibility features consistent with the innovations herein may utilize finite impulse response (FIR) filters, such as N-tap filters or filtration processes. Below, 9-tap filtering is used to illustrate provision of exemplary analysis/valuation of pixels, such as deviation. As well known in the art basic equations for a 9-tap detection filter (assuming polarity of coefficients) for 9-tap low-pass $L_0$ and 9-tap high-pass $H_0$ filtering respectively are: $L_0=a_4(d_{-4}+d_4)+a_3(d_{-3}+d_3)+a_2(d_{-2}+d_2)+a_1(d_{-1}+d_1)+a_0d_0$ $H_0=b_4(d_{-4}+d_4)+b_3(d_{-3}+d_3)+b_2(d_{-2}+d_2)+b_1(d_{-1}+d_1)+b_0d_0$, wherein $a_4$, $a_3$, $a_2$, $a_1$, $a_0$ represent the low-pass filter coefficients, $b_4$, $b_3$, $b_2$, $b_1$, $b_0$ represent the high-pass filter coefficients and $d_{-4}$, $d_4$, $d_{-3}$, $d_3$, $d_{-2}$, $d_2$, $d_{-1}$, $d_0$ represent the input video data points be filtered. It should be appreciated that the above equations representing the low-pass filtering and high-pass filtering have been simplified due to the symmetry of the coefficients about the 0 tap of a digital FIR filter.

Turning to FIG. 3A, a series of pixels, y1 through y9, may be considered in connection with obtaining appropriate analysis/expression of a pixel currently under consideration (here, pixel y5). Consistent with such exemplary 9-tap processes, then, expression of deviation (dev) for this example, then, may correspond to:

$$dev=(y1+y2+y3+y4+y6+y7+y8+y9)-(y5*8)$$

Further graphical and mathematical expressions for sequences of such pixels, including specification of regions (region 0, region 1, region 2, etc.) adjacent to a ramp step junction, then, may be seen in the exemplary illustrations of FIG. 3B and in the equations below.

It should be noted that, while a few representative examples are set forth herein to illustrate aspects of the present innovations, a variety of region segmentations and corresponding assignment of threshold values may be used to accomplish the innovations herein. Further, the carry possibility may be calculated as a higher and higher percentage as the region approaches the ramp step boundary. In some implementations, for example, the carry possibilities may be set to a series of escalating percentages, and any appropriate set of numerical values may be applied, here. In the one illustrative example, representative carry percentages of 25%, 50% and 75% may be provided by the following derivation:

```
If (dev < 0)
    Carry possibility = T0;
else if (R0 <= dev < R1)
    carry possibility = T1;
else if (R1 <= dev < R2)
    carry possibility = T2;
else
    carry possibility = T3;
where T0 = 0, T1 = 0.25, T2 = 0.5, T3 = 0.75
```

Here, in a representative example where the pixels are delineated into 4 regions (region0, region1, region2 and region3), and assuming 8-bit processing and 1-bit difference, values for TH would be TH0=12, TH1=10, TH2=8, TH3=6, and TH4=4. As such, the pixel at region3 would have a 75% carry possibility, the pixel at region2 would have a 50% carry possibility, the pixel at region1 would have a 25% carry possibility, and any of the earlier (further) regions would have a carry possibility of 0%.

FIG. 3C is a diagram illustrating another exemplary region-designated implementation, with 6 regions and 6 carry possibilities, consistent with certain aspects related to the innovations herein.

In FIG. 3C, the carry possibilities may be set to a series of escalating percentages corresponding to 6 increments or steps. In this illustrative implementation, then, the corresponding percentages or increments may be provided by derivations such as:

```
If (dev < 0)
    Carry possibility = T0;
else if (dev <= REG_RAMP_REGION0)
    Carry possibility = T1 – (REG_RAMP_TH0 / 16)
else if (dev <= REG_RAMP_REGION1)
    Carry possibility = T1 – (REG_RAMP_TH1 / 16)
else if (dev <= REG_RAMP_REGION2)
    Carry possibility = T1 – (REG_RAMP_TH2 / 16)
else if (dev <= REG_RAMP_REGION3)
    Carry possibility = T1 – (REG_RAMP_TH3 / 16)
else
    Carry possibility = T1 – (REG_RAMP_TH4 / 16)
```

Figure 4:
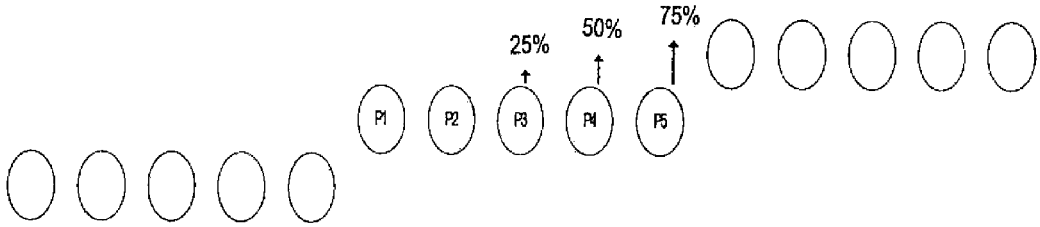
FIG. 4 is a diagram illustrating an exemplary implementation of smoothing consistent with certain aspects related to the innovations herein.

FIG. 4 is a diagram illustrating another representative example of smoothing consistent with certain aspects related to the innovations herein. Referring to FIG. 4, five subject pixels or regions are shown. Here, consistent with the exemplary equations and calculations above, the carry possibilities for P1 through P5 are as follows: P1 carry possibility is about 0%, P2 carry possibility is about 0%, P3 carry possibility is about 25%, P4 carry possibility is about 50%, and P5 carry possibility is about 75%.

Figure 5:
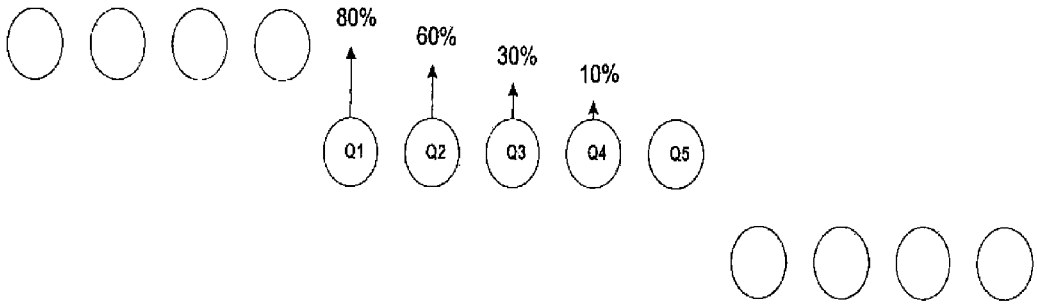
FIG. 5 is a diagram illustrating an exemplary implementation of smoothing consistent with certain aspects related to the innovations herein.

FIG. 5 is a diagram illustrating another representative example of smoothing consistent with certain aspects related to the innovations herein. Referring to FIG. 5, five subject pixels or regions are also shown. Here, consistent with the exemplary equations and calculations above, the carry possibilities for Q1 through Q5 are as follows: Q1 carry possibility is about 80%, Q2 carry possibility is about 60%, Q3 carry possibility is about 30%, Q4 carry possibility is about 10%, and Q5 carry possibility is about 0%.

Figure 6:
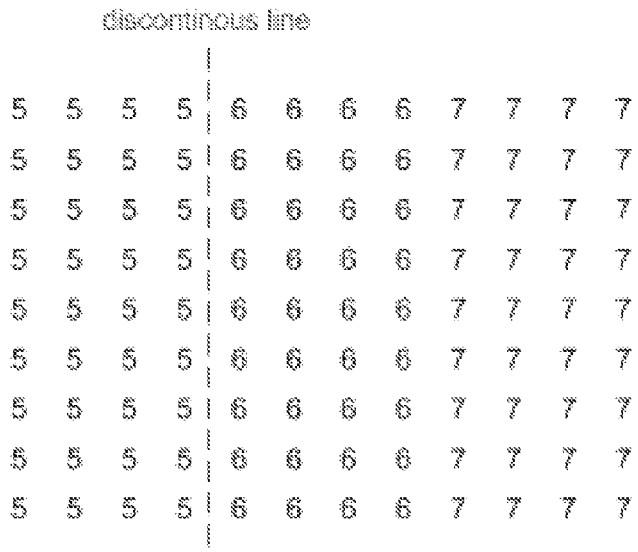
FIG. 6 is a diagram illustrating discontinuities, showing a discontinuous line, consistent with certain aspects related to the innovations herein.

FIG. 6 is a diagram illustrating discontinuities, showing a discontinuous line, consistent with certain aspects related to the innovations herein. Referring to the ramp pattern illustrated in FIG. 6, there is a discontinuous line between value 5 and 6, where value 5, 6, 7 are gray level values.

According to the instant innovations, however, the idealized goal of aspects of the present implementations is to provide output (e.g., line) results as close to the following as possible:

5.00 5.25 5.50 5.75 6.00 6.25 6.50 6.75 7.00 7.25 7.50 7.75

Of course, such fractional numbers are not possible. Consistent with aspects of the innovations herein, however, an effective value of, e.g. 5.25, may be achieved for a certain column (for example, column 2). In the temporal domain, for example, for every 4 successive frames, exemplary implementations consistent with the innovations herein may set one frame to a value 6, while keeping 3 frames at value 5. As such, a value "5.25" may be obtained. Additionally, in the spatial domain, for every 4 pixels, implementations consistent with the innovations herein may set one pixel to a value 6, while keeping the others at a value of 5. This, too, affords an effective value of "5.25." Further, in implementations where the temporal and spatial domains are combined, the column 2 will achieve (look like) a value of "5.25".

In the above "5.25" representative implementation, for example, one frame is set to a value of 6 for every four frames. In other words, a carry possibility of 25% has been assigned to the pixel in question to be set at value 6. One exemplary manner of setting such possibilities may include generation of a random number (for example, from 0 to 99). Further, a threshold T may be set to value 7.5. By comparing the random number with T, implementations herein can determine the 25% possibility, with regard to which the random number is larger than T. In another example, simulation of other values (indeed, of any and all possibilities) may be achieved, e.g., a value of 7.9. Here, T may be set to 10, and the possibility of that a value 7 may be shifted to value 8 may be set at 90%. As such, a pixel value having an appearance (average appearance/appearance possibility) of 7.9 is achieved.

Figure 7A:
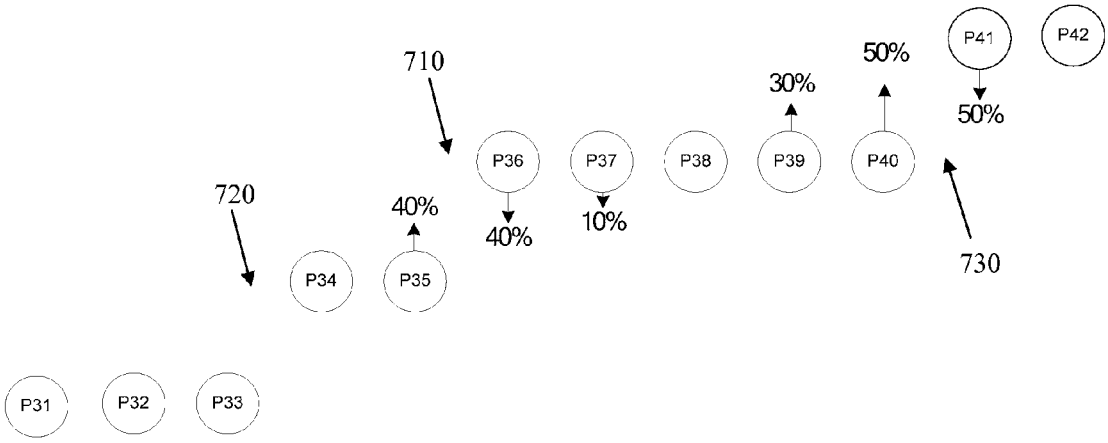
FIGS. 7A-7F are diagrams illustrating an exemplary implementations of smoothing consistent with certain aspects related to the innovations herein.

FIG. 7A is a diagram illustrating another exemplary implementation of smoothing consistent with certain aspects related to the innovations herein. As shown in FIG. 7A, a variety of pixel value increasing and/or pixel value decreasing may also be used to achieve smoothing consistent with the innovation herein. Here, by way of illustration not limitation, a representation using several exemplary pixel value increasing and decreasing features is shown. For example, at a first discontinuity 710 between P35 and P36, a pixel at pixel index P35 on the left side of the first discontinuity 710 may be assigned a 40% carry possibility to increase its pixel value. Further, the pixel on the right side of the discontinuity, P36, may be assigned a 40% carry possibility to decrease its pixel value. Further, pixels at pixel indexes further from the discontinuity may be assigned lower percentages to either increase or decrease their pixel values. In FIG. 7A, for example, P37 is shown as having assigned a 10% decrease possibility, while P34 has not been assigned any pixel value change possibility due to its location at an adjacent discontinuity 720. Of course, differing pixel value change possibility assignments may also be implemented. As also shown in FIG. 7A, for example, another set of pixel value increase and decrease possibilities are illustrated at a second discontinuity 730 between P40 and P41. Here, both of pixel indexes on the discontinuity, P40 and P41, may be assigned a 50% possibility to either increase or decrease their pixel values, respectively. Further, pixel indexes that are one-removed from the discontinuity (e.g., P39, here), may be assigned a change possibility of 30% to either increase or decrease their pixel values. Lastly, while exemplary pixel value increase/decrease possibility combinations of 'about 40%+about 10%' and 'about 50%+about 30%' are used herein, any suitable combinations of 1 or more pixel carry possibilities, including but not limited to those of FIGS. 7B-7D, or combinations thereof, may be utilized consistent with the innovations herein.

Figure 7B:
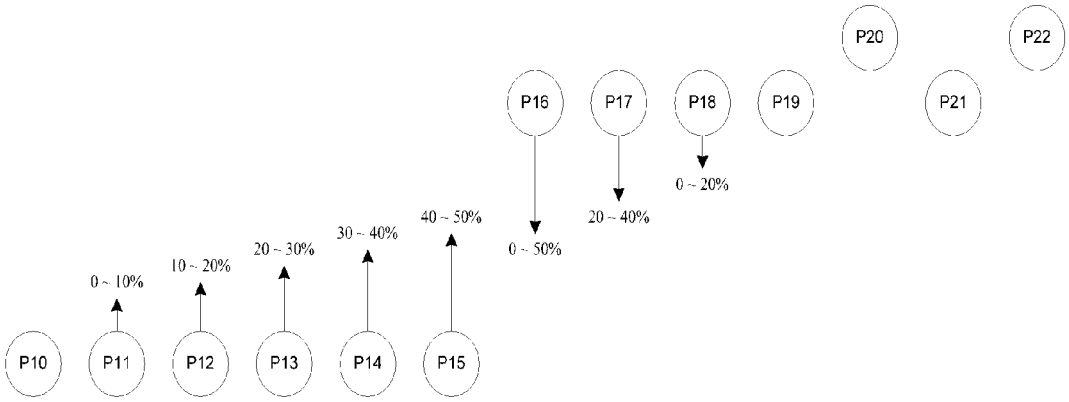
Figure 7C:
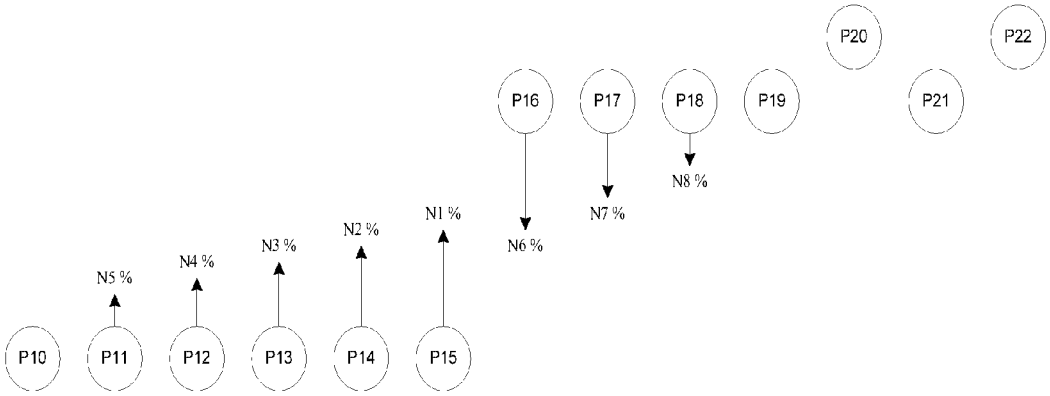

FIGS. 7B-7C are diagrams illustrating further exemplary implementations of smoothing consistent with the more specific examples set forth above. As shown in FIG. 7B, for example, a variety of exemplary ranges of carry possibilities in proximity to discontinuities are shown. Of course, the carry percentages are not necessarily limited to certain numbers or ranges, as they can actually range from 0% to 100%. See, for example, FIG. 7C, where N1-N8 could be 0 to 100. As such, as also set forth by way of example with regard to FIGS. 7D-7F, below, generalized mathematical expressions may be utilized to provide overall carry percentages for various pixel arrangements encountered. Further, according to some exemplary implementations, the percentage value may be dependent on FIR result, the relationship between center pixel, and surrounding pixel location/information.

Figure 7D:
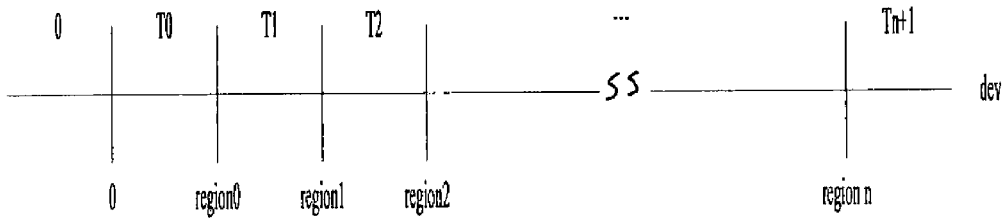
Figure 7E:
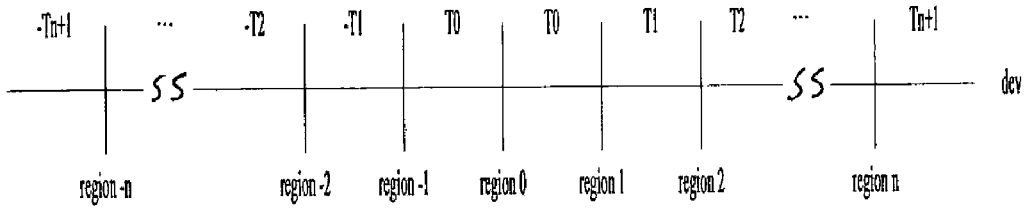
Figure 7F:
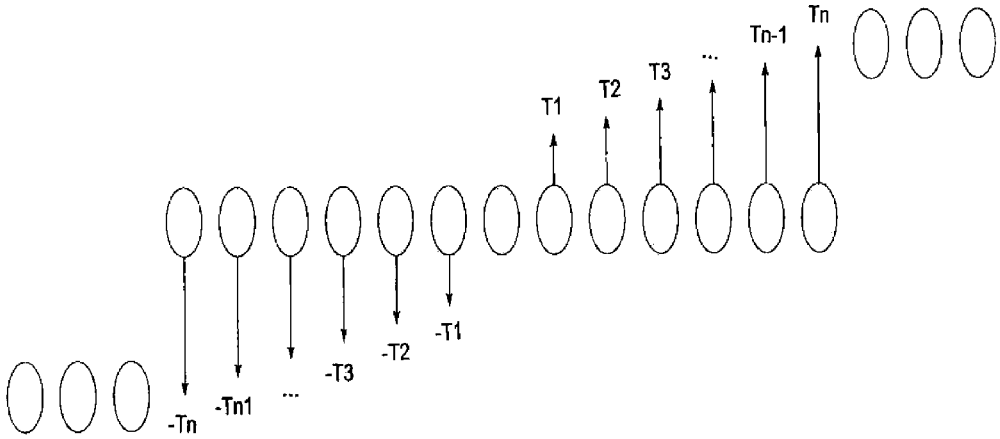

FIGS. 7D-7F are diagrams illustrating further exemplary implementations of generalized carry percentages and/or smoothing features consistent with certain aspects related to the innovations herein. Given that a carry possibility may be expressed as a function Carry possibility=f (dev, region, T), where dev is, e.g., a filter result and region and T are predetermined parameters as set forth herein, the following general expressions of carry percentage may be utilized. As shown in FIG. 7D, for example, general carry percentages for one-way (e.g., increase) in carry percentage may be expressed via the information and parameters set forth therein. Additionally, as also set forth in the exemplary representations of FIGS. 7E and 7F, general carry percentages for two-way carry (e.g., increase and drop off) may be expressed via the information and parameters set forth therein.

One exemplary formula for the carry percentage drop off, then, consistent with these representations, may be expressed:

```
If (dev < region_n)
    Carry possibility = −T_{n+1}
else if (dev < region_{n−1})
    Carry possibility = −T_n
        [....]
else if (dev < region_1)
    Carry possibility = −T_1
else
    Carry possibility = T_0
```

Here, for example, pixel value drop off may be similar to pixel value increase. As such, the value (i.e., picture intensity, etc.) will be changed only if the "increase" or "decrease" is actually triggered. Moreover, a further advantage of utilizing both increasing and decreasing carry possibilities is that intensity will be the same.

As disclosed herein, embodiments and features of the present innovations may be implemented through computer-hardware, software and/or firmware. For example, the systems and methods disclosed herein may be embodied in various forms including, for example, a data processor, such as a computer that also includes a database, digital electronic circuitry, firmware, software, or in combinations of them.

Figure 8A:
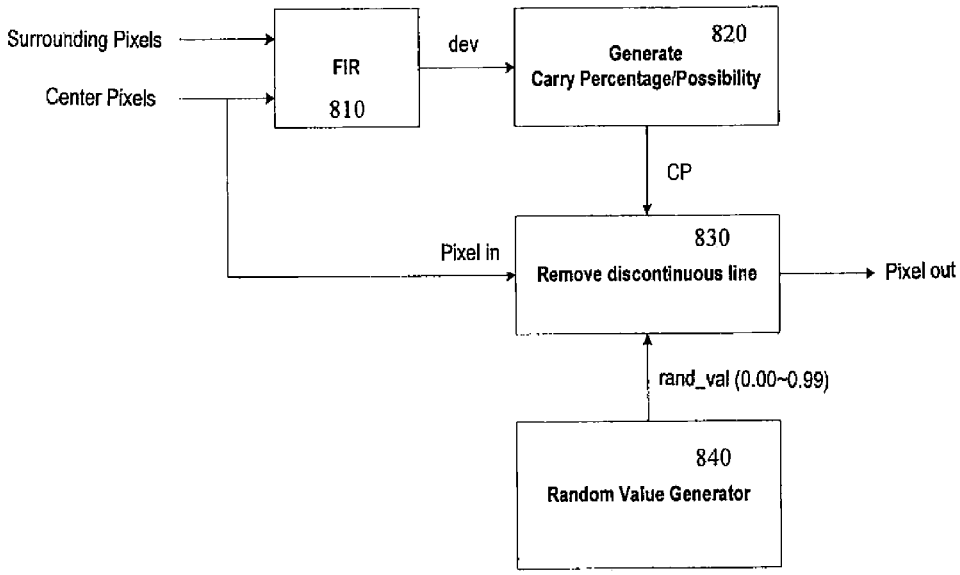
FIGS. 8A-8C are diagrams illustrating an exemplary components for implementing smoothing consistent with certain aspects related to the innovations herein.
Figure 8B:
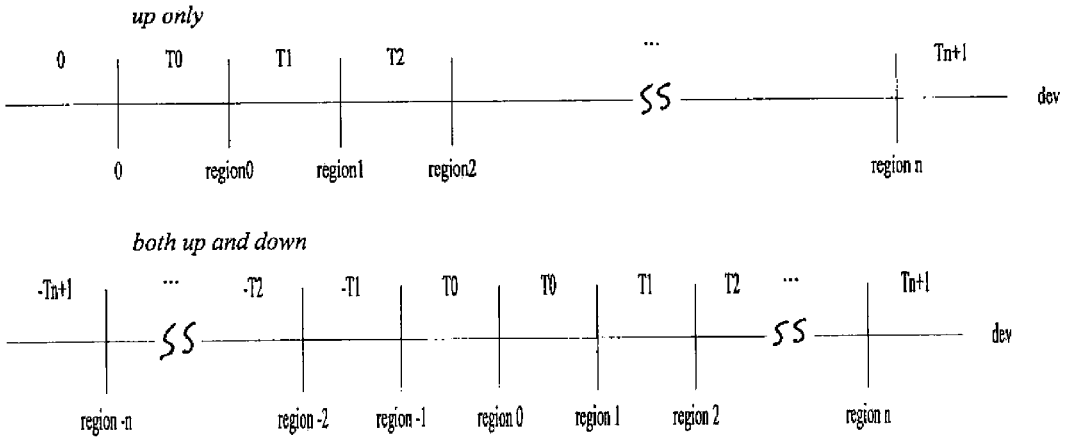
Figure 8C:
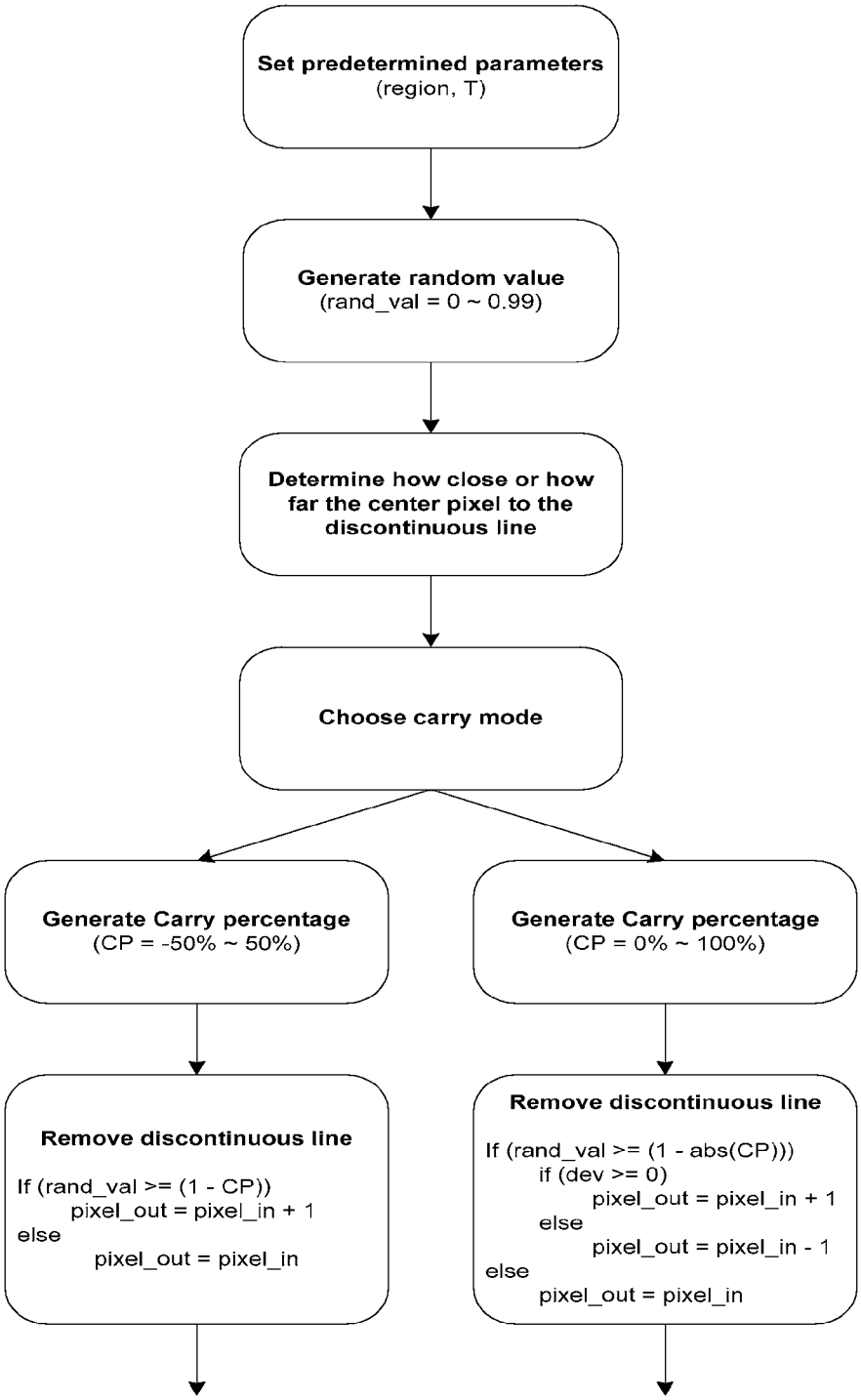

FIGS. 8A-8C, for example, are diagrams illustrating an exemplary components (hardware, software, etc.) for implementing smoothing consistent with certain aspects related to the innovations herein. As shown in FIG. 8A, "dev" may be calculated (e.g., via FIR 810) from a center pixel and surrounding pixels to indicate how close or how far the center pixel to the discontinuous line. Next, in this exemplary implementation, carry percentage/possibility value (CP) may be generated, for example, by a component and/or software equation 820 such as CP=f(dev, region, T). Also, it should be noted, with regard to this exemplary relationship, that the function f may be non-linear and implemented by a LUT (lookup table). Further, "dev" may be separated into several regions, and a different percentage value may also be assigned to every region; see, e.g., FIG. 8B. Of course, such exemplary functionality may also be simplified to a linear function. (e.g. CP=K*dev, where K is a constant value).

In this exemplary implementation, a component 840 may generate a random value (rand_val), which may be, for example, from 0 to 0.99. Then, any of the features and/or functionality consistent with modifying the pixel value to remove the discontinuous line, as set forth herein, may be employed via another component 830. For example, for up only, component 830 may effectuate:

```
If (rand_val >= (1 − CP))
    pixel_out = pixel_in + 1
else
    pixel_out = pixel_in
```

Further, for both up and down carry possibility, component 830 may effectuate:

```
If (rand_val >= (1 − abs(CP)))
    if (dev >= 0)
        pixel_out = pixel_in + 1
    else
        pixel_out = pixel_in − 1
else
    pixel_out = pixel_in
```

FIG. 8C illustrates such representative features via exemplary flow diagram, which summarizes the functionality set forth above. Further, while some of the disclosed implementations describe components suitable for implementation via software, systems and methods consistent with the present invention may be implemented with any combination of hardware, software and/or firmware. Moreover, the above-noted features and other aspects and principles of the present invention may be implemented in various environments. Such environments and related applications may be specially constructed for performing the various processes and operations according to the invention or they may include a general-purpose computer or computing platform selectively activated or reconfigured by code to provide the necessary functionality. The processes disclosed herein are not inherently related to any particular computer, network, architecture, environment, or other apparatus, and may be implemented by a suitable combination of hardware, software, and/or firmware. For example, various general-purpose machines may be used with programs written in accordance with teachings of the invention, or it may be more convenient to construct a specialized apparatus or system to perform the required methods and techniques.

The systems and methods disclosed herein may be implemented as a computer program product, i.e., a computer program tangibly embodied in an information carrier, e.g., in a machine readable storage medium or element or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand alone program or as a module, component, subroutine, or other unit suitable for use in a computing environment. A computer program can be deployed to be executed on one computer or on multiple computers at one site or distributed across multiple sites and interconnected by a communication network.

It is to be understood that the foregoing description is intended to illustrate and not to limit the scope of the invention, which is defined by the scope of the appended claims. Other embodiments are within the scope of the following claims.

What is claimed is:

1. A method of performing computerized processing of image data comprising:

analyzing, via a computer, first display information including pixel data indicative of pixel display on a graphical user interface;

detecting one or more ramp steps in the pixel data assigning, in association with random number generation and/or threshold setting functionality, a carry possibility for a pixel adjacent the one or more ramp steps; and generating second display information including adjusted pixel data for pixels adjacent the ramp steps;

wherein the second display information includes pixel values adjusted according to the carry possibility in one or both of the temporal domain and/or spatial domain;

wherein the carry possibility is an adaptive carry possibility characterized in that carry possibilities for pixels adjacent the one or more ramp steps are accorded progressively smaller possibilities as a function of the pixel's increasing distance from the adjacent ramp step;

wherein differing carry possibilities are assigned to pixels as a function of deviation from the one or more ramp steps;

wherein, when deviation (dev) is characterized mathematically as (y1+y2+y3+y4+y6+y7+y8+y9)−(y5*8) for pixels "y," the carry possibility is provided via:

```
If (dev < 0)
    Carry possibility = T0;
else if (R0 <= dev < R1)
    carry possibility = T1;
else if (R1 <= dev < R2)
    carry possibility = T2;
else
    carry possibility = T3;
```

where T0=0, T1=0.25, T2=0.5, T3=0.75, and R0, R1, and R2 specify regions 0, 1, and 2 adjacent to a ramp step junction, respectively.

2. The method of claim 1 wherein the carry possibility is a percentage possibility that the pixel adjacent the one or more ramp steps is assigned a pixel value equal to a pixel across the ramp step.

3. The method of claim 2 further comprising assigning a plurality of carry possibilities, wherein the plurality of carry possibilities include a low possibility, a medium possibility, and a high possibility.

4. The method of claim 3 wherein the low possibility is 25%, the medium possibility is 50%, and the high possibility is 75%.

5. The method of claim 1 further comprising using a 9-tap median filtering process in association with assigning the carry possibility.

6. The method of claim 1 wherein the carry possibility is an adaptive carry possibility characterized in that carry possibilities for pixels adjacent the one or more ramp steps are accorded progressively smaller possibilities as a function of the pixel's increasing distance from the ramp step.

7. The method of claim 6 wherein differing carry possibilities are assigned to pixels as a function of regions offset from the ramp step that are identified via a filtering process.

8. The method of claim 7 wherein differing carry possibilities are assigned to pixels as a function of deviation from the one or more ramp steps.

9. The method of claim 6 wherein differing carry possibilities are assigned to pixels as a function of deviation from the one or more ramp steps.

10. A method of performing computerized processing of image data comprising:

analyzing, via a computer, first display information including pixel data indicative of pixel display on a graphical user interface;

detecting one or more ramp steps in the pixel data assigning, in association with random number generation and/or threshold setting functionality, a carry possibility for a pixel adjacent the one or more ramp steps; and generating second display information including adjusted pixel data for pixels adjacent the ramp steps;

wherein the second display information includes pixel values adjusted according to the carry possibility in one or both of the temporal domain and/or spatial domain;

wherein the carry possibility is an adaptive carry possibility characterized in that carry possibilities for pixels adjacent the one or more ramp steps are accorded progressively smaller possibilities as a function of the pixel's increasing distance from the adjacent ramp step;

wherein differing carry possibilities are assigned to pixels as a function of deviation from the one or more ramp steps;

wherein, when deviation (dev) is characterized mathematically as (y1+y2+y3+y4+y6+y7+y8+y9)−(y5*8) for pixels "y," the carry possibility is provided via:

```
if (dev < 0)
    Carry possibility = 0;
else if (dev <= REG_RAMP_REGION0)
    Carry possibility = 1 − (REG_RAMP_TH0 / 16)
else if (dev <= REG_RAMP_REGION1)
    Carry possibility = 1 − (REG_RAMP_TH1 / 16)
else if (dev <= REG_RAMP_REGION2)
    Carry possibility = 1 − (REG_RAMP_TH2 / 16)
else if (dev <= REG_RAMP_REGION3)
    Carry possibility = 1 − (REG_RAMP_TH3 / 16)
else
    Carry possibility = 1 − (REG_RAMP_TH4 / 16)
```

wherein REG_RAMP_TH(n) is a function specifying ramp regions of the quantity of regions off the ramp step, "n" regions off, with REG_RAMP_REGION0, REG_RAMP_REGION1, REG_RAMP_REGION2, and REG_RAMP_REGION3 corresponding to regions 0, 1, 2, and 3 adjacent to a ramp step junction, respectively.

11. An image processing system comprising:

an article of manufacture containing non-transistory computer readable media embodying computer readable instructions executable by a machine/processor to:

analyze first display information including pixel data indicative of pixel display on a graphical user interface;

detect one or more ramp steps in the pixel data;

assign, in association with random number generation and/or threshold setting functionality, a carry possibility for a pixel adjacent the one or more ramp steps; and generate second display information including adjusted pixel data for pixels adjacent the ramp steps;

wherein the second display information includes pixel values adjusted according to the carry possibility in one or both of the temporal domain and/or spatial domain;

wherein the carry possibility is an adaptive carry possibility characterized in that carry possibilities for pixels adjacent the one or more ramp steps are accorded progressively smaller possibilities as a function of the pixel's increasing distance from the adjacent ramp step;

wherein differing carry possibilities are assigned to pixels as a function of deviation from the one or more ramp steps;

wherein, when deviation (dev) is characterized mathematically as (y1+y2+y3+y4+y6+y7+y8+y9)−(y5*8) for pixels "y," the carry possibility is provided via:

```
If (dev < 0)
    Carry possibility = T0;
else if (R0 <= dev < R1)
    carry possibility = T1;
else if (R1 <= dev < R2)
    carry possibility = T2;
else
    carry possibility = T3;
```

where T0=0, T1=0.25, T2=0.5, T3=0.75, and R0, R1, and R2 specify regions 0, 1, and 2 adjacent to a ramp step junction, respectively.

12. The system of claim 11 wherein the carry possibility is a percentage possibility that the pixel adjacent the one or more ramp steps is assigned a pixel value equal to a pixel across the ramp step.

13. The system of claim 12 further comprising assigning a plurality of carry possibilities, wherein the plurality of carry possibilities include a low possibility, a medium possibility, and a high possibility.

14. The system of claim 13 wherein the low possibility is 25%, the medium possibility is 50%, and the high possibility is 75%.

15. The system of claim 11 further comprising using a 9-tap median filtering process in association with assigning the carry possibility.

16. The system of claim 11 wherein the carry possibility is an adaptive carry possibility characterized in that carry possibilities for pixels adjacent the one or more ramp steps are accorded progressively smaller possibilities as a function of the pixel's increasing distance from the ramp step.

17. The system of claim 16 wherein differing carry possibilities are assigned to pixels as a function of regions offset from the ramp step that are identified via a filtering process.

18. The system of claim 17 wherein differing carry possibilities are assigned to pixels as a function of deviation from the one or more ramp steps.

19. The system of claim 16 wherein differing carry possibilities are assigned to pixels as a function of deviation from the one or more ramp steps.

20. An image processing system comprising:

an article of manufacture containing non-transistory computer readable media embodying computer readable instructions executable by a machine/processor to:

analyze first display information including pixel data indicative of pixel display on a graphical user interface;

detect one or more ramp steps in the pixel data;

assign, in association with random number generation and/or threshold setting functionality, a carry possibility for a pixel adjacent the one or more ramp steps; and generate second display information including adjusted pixel data for pixels adjacent the ramp steps;

wherein the second display information includes pixel values adjusted according to the carry possibility in one or both of the temporal domain and/or spatial domain;

wherein the carry possibility is an adaptive carry possibility characterized in that carry possibilities for pixels adjacent the one or more ramp steps are accorded progressively smaller possibilities as a function of the pixel's increasing distance from the adjacent ramp step;

wherein differing carry possibilities are assigned to pixels as a function of deviation from the one or more ramp steps;

wherein, when deviation (dev) is characterized mathematically as (y1+y2+y3+y4+y6+y7+y8+y9)−(y5*8) for pixels "y," the carry possibility is provided via:

```
if (dev < 0)
    Carry possibility = 0;
else if (dev <= REG_RAMP_REGION0)
    Carry possibility = 1 − (REG_RAMP_TH0 / 16)
else if (dev <= REG_RAMP_REGION1)
    Carry possibility = 1 − (REG_RAMP_TH1 / 16)
else if (dev <= REG_RAMP_REGION2)
    Carry possibility = 1 − (REG_RAMP_TH2 / 16)
else if (dev <= REG_RAMP_REGION3)
    Carry possibility = 1 − (REG_RAMP_TH3 / 16)
else
    Carry possibility = 1 − (REG_RAMP_TH4 / 16)
```

wherein REG_RAMP_TH(n) is a function specifying ramp regions of the quantity of regions off the ramp step, "n" regions off, with REG_RAMP_REGION0, REG_RAMP_REGION1, REG_RAMP_REGION2, and REG_RAMP_REGION3 corresponding to regions 0, 1, 2, and 3 adjacent to a ramp step junction, respectively.

21. The method of claim 10 wherein the carry possibility is a percentage possibility that the pixel adjacent the one or more ramp steps is assigned a pixel value equal to a pixel across the ramp step.

22. The system of claim 20 wherein the carry possibility is a percentage possibility that the pixel adjacent the one or more ramp steps is assigned a pixel value equal to a pixel across the ramp step.

* * * * *